US010499732B2

(12) United States Patent
Costa

(10) Patent No.: US 10,499,732 B2
(45) Date of Patent: Dec. 10, 2019

(54) SYSTEMS FOR QUICK MOUNTING AND FIXING APPLIED TO A CABINET BODY

(71) Applicant: Victor Penna Costa, Nova Lima (BR)

(72) Inventor: Victor Penna Costa, Nova Lima (BR)

( * ) Notice: Subject to any disclaimer, the term of this patent is extended or adjusted under 35 U.S.C. 154(b) by 0 days.

(21) Appl. No.: 15/685,194

(22) Filed: Aug. 24, 2017

(65) Prior Publication Data

US 2019/0059577 A1 Feb. 28, 2019

(51) Int. Cl.
*A47B 47/02* (2006.01)
*A47B 87/00* (2006.01)

(52) U.S. Cl.
CPC ..... *A47B 47/021* (2013.01); *A47B 47/025* (2013.01); *A47B 87/007* (2013.01); *A47B 2220/0058* (2013.01)

(58) Field of Classification Search
CPC ..... A47B 2230/16; A47B 2220/0058; A47B 47/00; A47B 47/0066; A47B 47/02; A47B 47/021; A47B 47/025; A47B 47/0075; A47B 47/042; A47B 47/0091; A47B 95/008
See application file for complete search history.

(56) References Cited

U.S. PATENT DOCUMENTS 2,521,134 A * 9/1950 Stanitz ..... A47B 95/008 211/72
3,157,446 A * 11/1964 Stark ..... A47B 17/003 312/195
4,145,098 A * 3/1979 Alexander ..... F16B 12/34 312/195
4,201,428 A * 5/1980 Johnson ..... A47B 47/03 312/108
4,793,667 A * 12/1988 Gilliom ..... A47B 47/03 312/108
5,412,916 A * 5/1995 Kennedy ..... E21F 1/14 405/132
6,209,976 B1 * 4/2001 Shear ..... A47B 47/02 312/257.1
6,409,293 B1 * 6/2002 Chang ..... A47B 47/02 312/257.1
6,786,009 B1 * 9/2004 McGunn ..... A47B 47/03 312/263
6,789,859 B1 * 9/2004 Ho ..... A47B 47/02 312/257.1

(Continued)

FOREIGN PATENT DOCUMENTS

BR PI0603865 A 12/2007
BR MU8903064 U2 6/2011

(Continued)

*Primary Examiner* — Andrew M Roersma
(74) *Attorney, Agent, or Firm* — Banner & Witcoff, Ltd.

(57) ABSTRACT

The present disclosure refers to systems applied to cabinet body that mates quick mounting and fixing, applied to the furniture area specially to steel cabinets, for joining took apart pieces by fitting and screwing them or for mounting and joining them by welding. The cabinet body presents steel back part having a bend that forms a small backlash and with eyebolt-shaped reliefs for quick mounting the cabinet boxes. The top part has a wedged-shaped bend that when is joined to the strip-shaped steel plate having the wedge bend opposed to the one of the back part, it can be fixed to any wall, and a quick installation of the cabinet box on the wall is allowed.

5 Claims, 6 Drawing Sheets

(56) References Cited

U.S. PATENT DOCUMENTS

Figure 1:
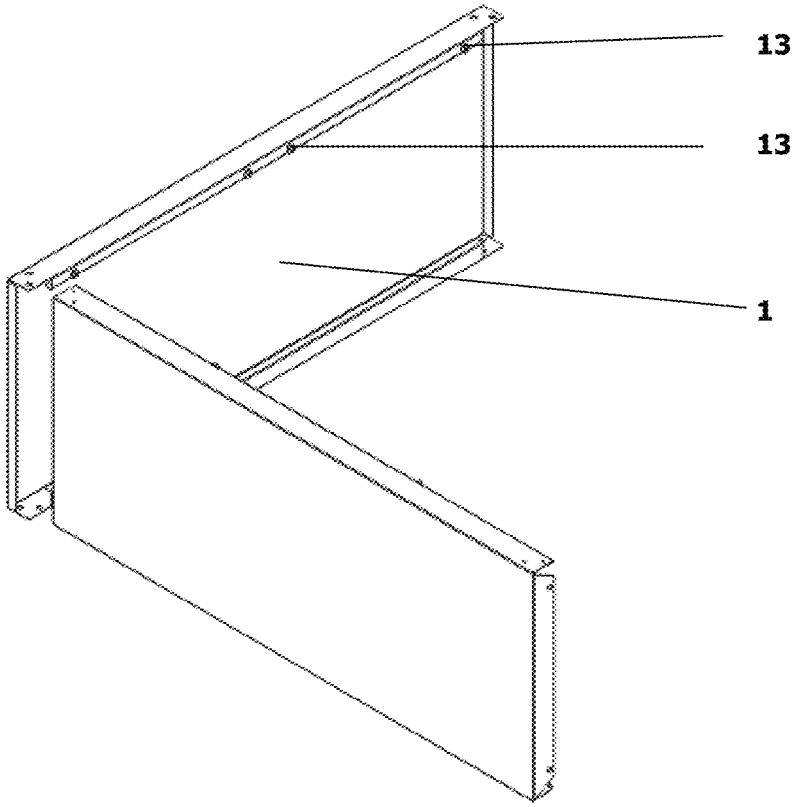

| | | | | |
|---|---|---|---|---|
| 2004/0090156 | A1* | 5/2004 | Kunanantakul | A47B 47/025<br>312/257.1 |
| 2004/0144741 | A1* | 7/2004 | Spencer | A47B 57/20<br>211/187 |
| 2006/0091271 | A1* | 5/2006 | Nowak | A47B 95/008<br>248/225.21 |
| 2008/0173778 | A1* | 7/2008 | Mertens | A47B 95/008<br>248/301 |
| 2017/0347793 | A1* | 12/2017 | Wang | A47B 47/03 |

FOREIGN PATENT DOCUMENTS

| | | | | |
|---|---|---|---|---|
| BR | 102014016208 | A2 | 2/2016 | |
| DE | 2020110511753 | U1 * | 1/2012 | A47B 47/00 |
| EP | 0532818 | A1 * | 3/1993 | A47B 7/0075 |

* cited by examiner

SYSTEMS FOR QUICK MOUNTING AND FIXING APPLIED TO A CABINET BODY

The present patent disclosure refers to systems applied to cabinet body that mates quick mounting and fixing applied to the furniture area, specially to steel cabinets, for joining took apart pieces by fitting and screwing them or for mounting and joining them by welding. The cabinet body presents steel back part having a bend that forms a small backlash, and eyebolt-shaped reliefs for quick mounting of the cabinet boxes. The top part has a wedged-shaped bend that when is joined to the strip-shaped steel plate having the wedge bend opposed to the one of the back part can be fixed to any wall, and a quick installation of the cabinet box on the wall is allowed.

The mounting systems currently used to mount box of took apart steel plate cabinets, specially to the back part, are fixed by joining the side, top and bottom parts to the back part, the side, top and bottom sections having bends that when in contact with the backside flat plate are joined using screws and nuts that pass through coincident bores. In another known system, the back part has a small backlash made by bends in contact with side, top and bottom parts of the cabinet, having U-shaped bends at the back part and fixed using screws and nuts or even self-tapping screw through coincident bores.

In turn, the systems, currently used to installation on a wall, commonly use a device that is fixed to the backside of the cabinet box back part, which is fitted to a panel having recesses that is fixed to the wall or can be fixed to the wall by the bores on the back part positioned at the installation place and fixed through screw and bush.

The document no BR 102014016208-9—entitled "SISTEMA CONSTRUTIVO DE MONTAGEM APLICADO EM ARMÁRIO" (CONSTRUCTIVE MOUNTING SYSTEM APPLIED TO CABINET)—consists of a cabinet preferably wooden cabinet, comprising two side plates, a cap, a fixed middle shelf, a bottom plate, a back plate, a double-sheet door, being provided with adjustable shelves, finishing bungs and support bungs, bun feet, screws, bulkhead plate and handles. The novelty consists of the fact of being provided with grooved plates, or slots, designed for fitting or locking, reducing the fixation by screws and eliminating weld. It differs from the present system for presenting cabinet, wooden plates and finishes, for fitting and locking by screws, while the present patent presents a quick-mounting system of steel plates applied to a cabinet body and having the fixing system coupled thereto.

The document no PI 0603865-4, owned by the present Applicant, is a CABINET MOUNTING SYSTEM WITH FIXING ELEMENT ("SISTEMA DE MONTAGEM DE ARMÁRIO COM ELEMENTO DE FIXAÇÃO"), of which assembly is structured by bent- or stamped-steel-molded pieces, the shape and size substantially corresponding one another to the fitting, which occurs concurrently at the moment of mounting, which gradually occurs by coupling through a common fixing element. The cabinet body presents side profiles provided with U-shaped bend, holes for fitting the fixing element, in addition to holes for fitting the back face; central faces or caps, having multiple functions of bottom, top and shelf, presenting side profiles provided with slots for coupling to the U-shaped sides, hole for fitting the fixing element pin, and coincident hole and for juxtaposition to the hole of the fixing element; the fixing element of the body being provided with a pin at the bottom, frontal hole, bottom hole, fitting for receiving a hinge and a hole for receiving a screw in order to allow the hinge to be fixed to the door. After the door having received the hinge fit, this is coupled to the element through the fit and fixed to it by the screw screwed into the hole, through the hinge fit (7.1). It differs from the present system because the cabinet fixing to the wall occurs using screws, while the present patent described herein presents wedged fitting pieces, in addition to present quick-mounting system having fixing system coupled thereto.

The document no MU 8903064-8—entitled "Disposição construtiva introduzida em dispositivos de montagem e fixação de partes componentes de armário metálico" (Constructive Arrangement inserted into fixing and mounting devices of parts composing metallic cabinet)—presents a fixing and mounting device of the couple of pieces composing the bottom; fixing and mounting device of the pieces composing the sides joined to the upper crossbar; fixing and mounting device of the shelves joined to the set of racks and fixing and mounting device of the back part of the top component, new constructive arrangement being inserted into the parts composing right and left side pieces; right and left bottom pieces, the rack piece, the shelf piece and the top piece. It differs from the present system for presenting locking bar, crossbar and extruded column supporting the cabinet structure, while the present patent do not have structural pieces, only fitting pieces, in addition to quick-mounting system of steel plates applied to cabinet body having fixing system coupled thereto.

The present system of mounting the cabinet box consists of a backside bend that enables exactly together with eyebolt-type reliefs a mounting to the back part by quickly fitting both sides, top and bottom parts, presents U-shaped bends at the back part which are prepared with screw prefixed without total adjust, that after passing the eyebolt through screw head will manually receive a final tightening needing no power wrench, allowing the quick and simplified mounting of the cabinet box to be done by any person.

The fixing system of the cabinet box on the wall consists of wedged-shaped bend at the upper back side, eliminating extra pieces that, together with the strip-shaped steel plate to be fixed to the wall, the wedge being opposed to the back part, enable quick, effective and secure mounting, without adding extra pieces to the fixing system, thus reducing the manufacturing processes, raw material use, final cost of the cabinets, in addition to enable the installation to be done by any person.

The present patent presents the following advantages:

- allowing the quick and secure mounting of the components;
- enabling pieces locking of the cabinet box in a effective and resistant manner;
- providing fitting of the eyebolt-shaped relief to a back part and to the heads of screws prefixed to both side, top and bottom of the cabinet box;
- allowing the installation of the cabinet to the wall in an extremely easy, quick, effective and secure manner;
- enabling the installation to the wall is done by a single person and requiring no an expert professional.

Figure 2:
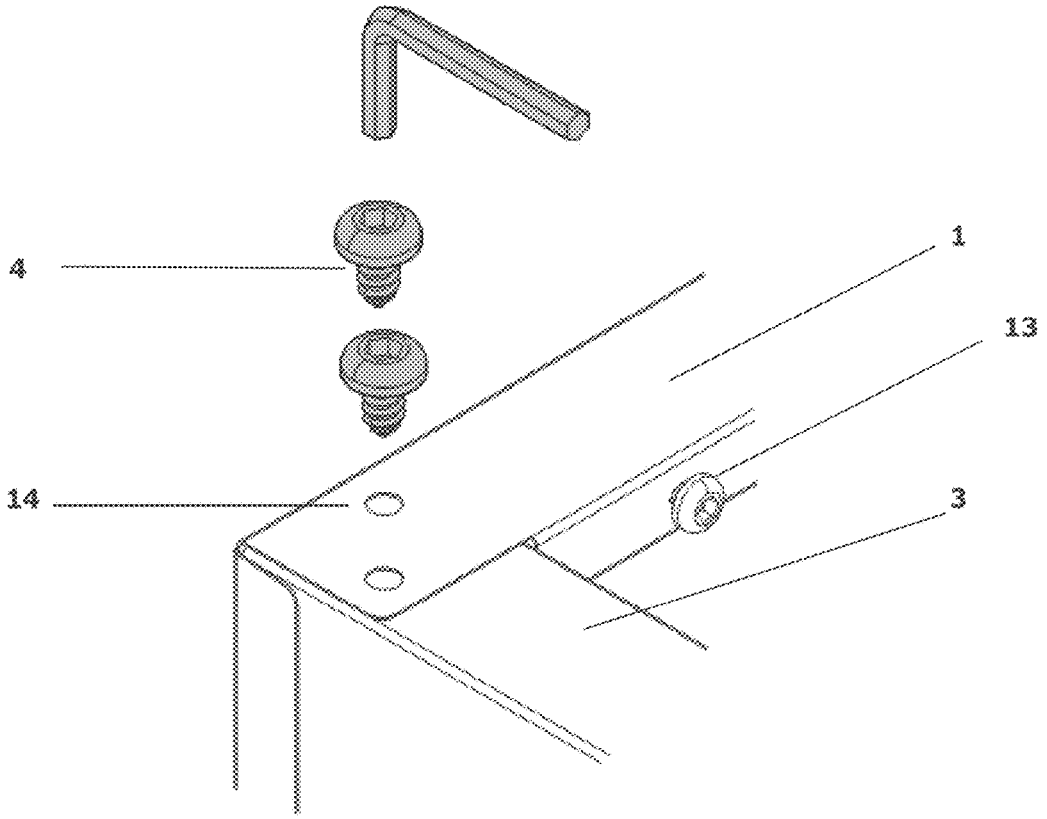
Figure 3:
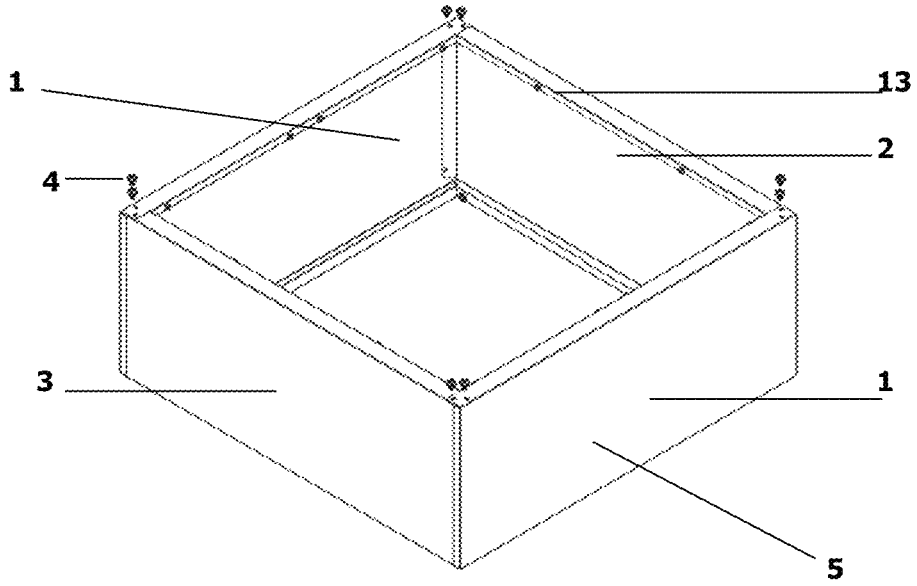
Figure 4:
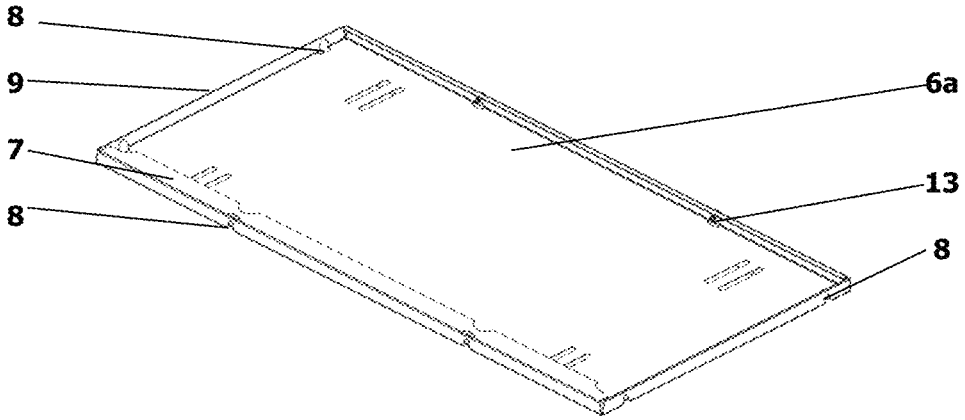
Figure 5:
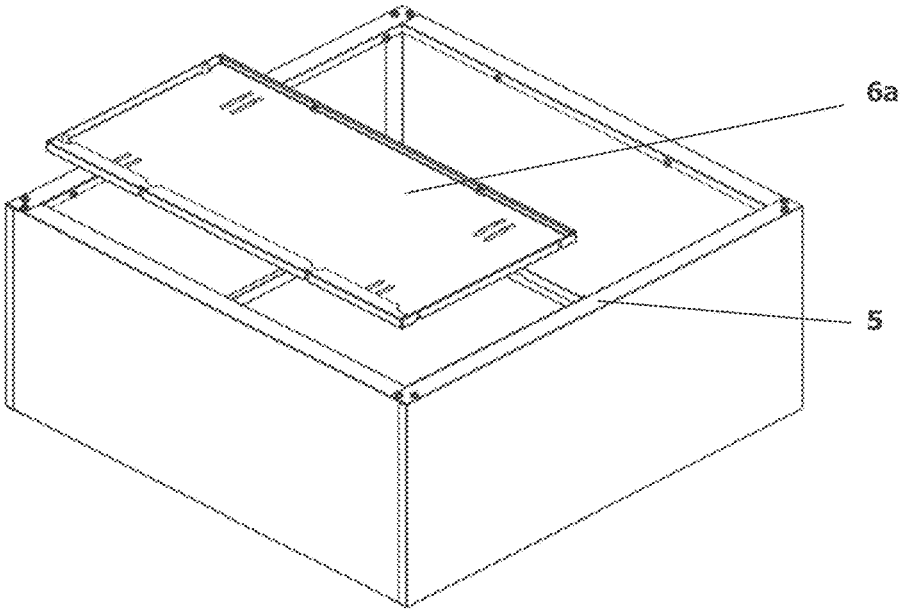
Figure 6:
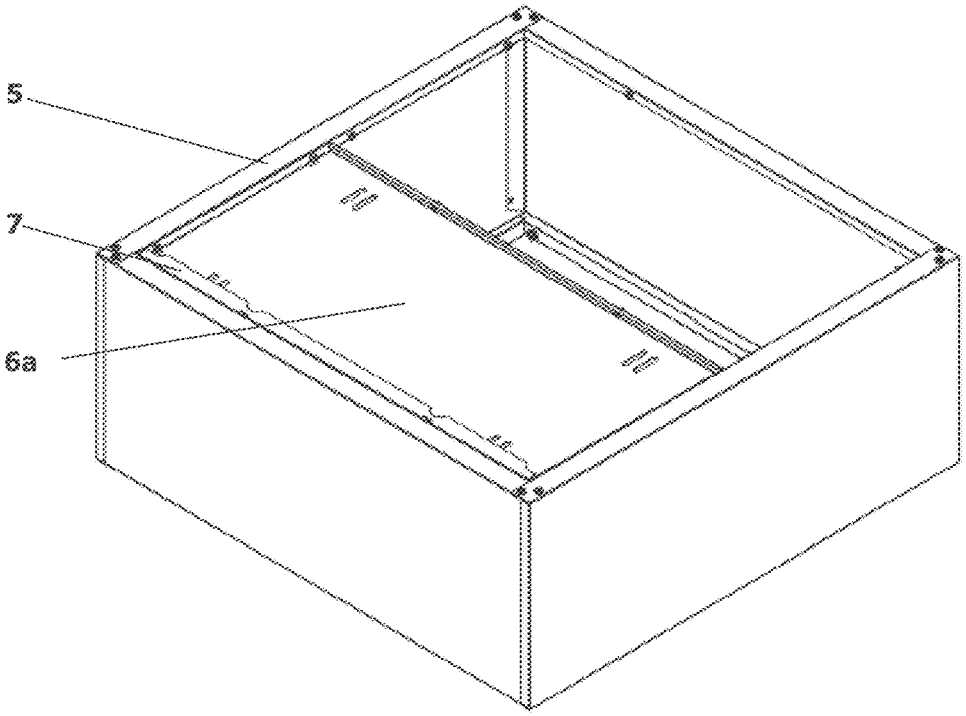
Figure 7:
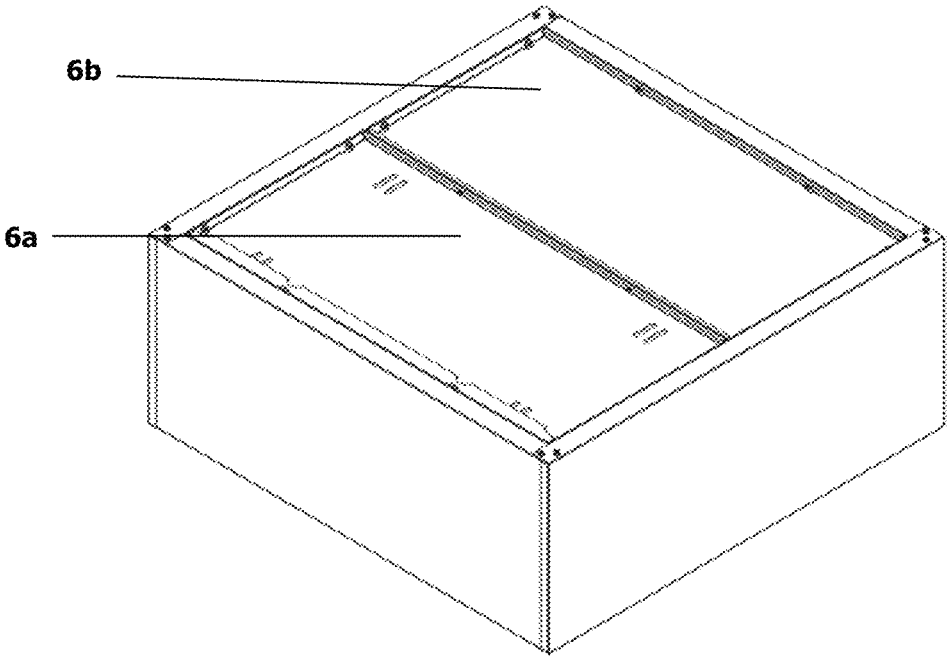
Figure 8:
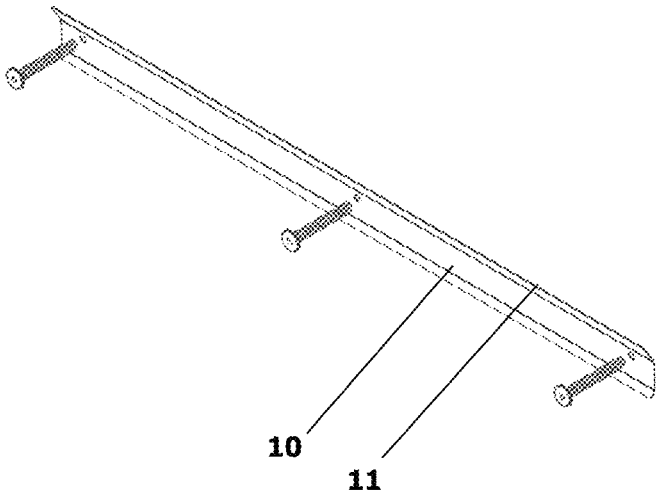
Figure 9:
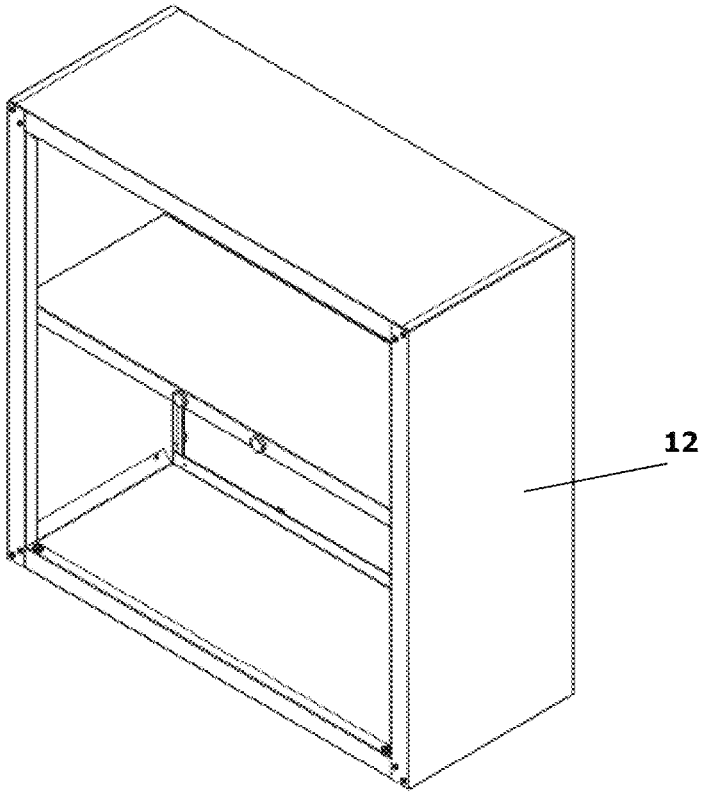

The systems described in the present patent may be seen in the appended figures, wherein:

the FIG. 1 illustrates a view of the side, top and bottom sections of the cabinet.

the FIG. 2 illustrates a detailed view of the mounting of the side with the top and bottom using screws for forming the box without the back part.

the FIG. 3 illustrates a view of the cabinet box mounted.

the FIG. 4 illustrates a view of one of the back parts provided with L- and U-shaped bend.

the FIG. 5 illustrate a view of the mounting sequence of the back parts of the cabinet being fixed to the box.

the FIG. 6 illustrates a view of one of the back parts of the cabinet fixed to the box.

the FIG. 7 illustrates a view of back part of the cabinet fixed to the box.

the FIG. 8 illustrates a view of the attachment rail being fixed to the wall.

the FIG. 9 illustrates view of the cabinet box fixedly mounted to the wall, with no doors yet.

According to the FIGS. 1 to 3, the side sections (1) are provided with prefixed screws (13) in order to be mounted to the top (2) and bottom (3), which also have prefixed screws (13), forming the frame (5) of the cabinet. The side sections (1) are fixed through self-tapping screws (4) or screws and nuts passing through coincident bores of the sides, top (2) and bottom (3), having a sized diameter for the self-tapping screw (4) providing locking when receiving tightening torque, forming a frame (5) with no back part (6) yet.

According to the FIGS. 4 to 7, the frame (5), formed by sides (1), top (2) and bottom (3) will receive the back parts (6), which may be bipartite (6*a* and 6*b*) or entire. The back parts (6) present in the upper section U-shaped bend (7) and eyebolt-shaped reliefs (8), and in the lower and sides sections, present L-shaped bends (9) and eyebolt-shaped reliefs (8) passing through the head of the prefixed screws (13) in the back part of both sides (1) and of the top (2). The upper section having the U-shaped bend (7), the last bend being bigger than the others and wedged-angled, will be positioned in parallel to the top (2), the box (5) being fixed to the wall of this. The mounting is finished by finally tightening the prefixed screws (13).

The mounting of the second back part is similar, having L-shaped bends (9) with eyebolt-shaped reliefs (8) at the sides (1) and at the lower part passing through the prefixed screws (13) of both sides (2) and at the bottom (3), thus mounting the box (5) of the cabinet, which will further receive amounts of shelves and doors as the model and size of the intended cabinet.

According to the FIG. 8, a strip-shaped steel ruler (10) with wedged-shaped bends (11) on both sides for having no position opposed to the section (6*a*) of the back parts of the cabinet (6), the U-shaped bend (7) having a bigger side forming a wedge that will serve as a fitting for installing the cabinet, is fixed to the wall of the installation place of the cabinet According to the FIG. 9, the mounted cabinet (12) is installed to the wall simply fitting the wedge of the back parts (6) to the wedge of the rule (10) of the wall, which is totally hidden behind the cabinet box.

The invention claimed is:

1. A system for quick mounting and fixing of a cabinet body to a wall, comprising: side sections (1) provided with prefixed screws (13), a top (2) comprising prefixed screws (13), and a bottom (3) comprising prefixed screws (13), wherein the side sections (1), top (2), and bottom (3) form a frame (5) of a cabinet, wherein the side sections (1) are fixed to the top (2) and to the bottom (3) through self-tapping screws (4) or screws and nuts passing through coincident bores (14) of the side sections (1), the top (2), and the bottom (3), the bores (14) having diameters sized for the self-tapping screws (4), the self-tapping screws (4) providing locking when receiving tightening torque, thereby forming the frame (5); wherein the frame (5) receives a back part (6) which is formed in one piece or two pieces (6*a* and 6*b*); wherein the back part (6) comprises a U-shaped bend (7) and eyebolt-shaped reliefs (8) in an upper section, and L-shaped bends (9) and eyebolt-shaped reliefs (8) in lower and side sections thereof, the eyebolt-shaped reliefs (8) in the lower and side sections of the back part (6) passing through heads of the prefixed screws (13) of the side sections (1) and of the bottom (3), wherein the U-shaped bend (7) is bigger than the L-shaped bends (9) and forms a wedge when the upper section of the back part (6) is positioned in parallel to the top (2) wherein the frame (5) can be fixed to a wall using the U-shaped bend (7) and screwing the prefixed screws (13).

2. The system of claim 1, further comprising a strip-shaped steel ruler (10) having a chamfer (11) on both sides in order to have no position when fixing to the U-shaped bend (7) on the back part (6), a bigger side forming one of the chamfers (11) which serves to install the cabinet on the wall when the strip-shaped steel ruler (10) is fixed to the wall.

3. The system claim 2, wherein the frame (5) is installed to the wall by simply fitting the U-shaped bend (7) of the back part (6) to the chamfer (11) of the ruler (10), the ruler (10) fixed to the wall and totally hidden behind the frame (5).

4. The system of claim 2, wherein the frame (5) is installed to the wall by simply fitting the U-shaped bend (7) of the back part (6) to one of the chamfers (11) of the ruler (10), the ruler (10) fixed to the wall and totally hidden behind the frame (5).

5. The system of claim 1, wherein, when the back part (6) is formed in first and second back part pieces (6*a* and 6*b*), wherein the first back part piece (6*a*) comprises the U-shaped bend (7), the L-shaped bends (9), and the eyebolt-shaped reliefs (8) for mounting the first back part piece (6*a*) to the prefixed screws (13) of the side sections (1) and the top (2), the second back part piece (6*b*) comprises the L-shaped bends (9) and the eyebolt-shaped reliefs (8) for mounting the second back part piece (6*b*) to the prefixed screws (13) of the side sections (1) and the bottom (3), wherein the frame (5) receives shelves and doors.

* * * * *